US005146285A

United States Patent [19]

Kikuchi et al.

[11] Patent Number: 5,146,285

[45] Date of Patent: Sep. 8, 1992

[54] IMAGE FORMING APPARATUS

[75] Inventors: Kazuhiko Kikuchi; Naruhito Yoshida, both of Kanagawa, Japan

[73] Assignee: Kabushiki Kaisha Toshiba, Kawasaki, Japan

[21] Appl. No.: 729,153

[22] Filed: Jul. 12, 1991

[30] Foreign Application Priority Data

Jul. 31, 1990 [JP] Japan ..... 2-203120

[51] Int. Cl.[5] ..... G03G 15/06

[52] U.S. Cl. ..... 355/270; 118/652; 118/653; 15/256.51; 355/296; 355/303

[58] Field of Search ..... 118/652, 651, 656; 355/268, 269, 270, 296, 297, 301, 302, 303; 15/1.51, 256.51

[56] References Cited

U.S. PATENT DOCUMENTS

| | | | |
|---|---|---|---|
| 4,007,983 | 2/1977 | Knieser | 355/297 |
| 4,664,504 | 5/1987 | Oda et al. | 355/297 |
| 4,727,395 | 2/1988 | Oda et al. | 355/270 X |
| 4,769,676 | 9/1988 | Mukai et al. | 355/269 |
| 4,779,119 | 10/1988 | Kaieda | 355/299 |
| 4,875,081 | 10/1989 | Goffe et al. | 355/303 |

FOREIGN PATENT DOCUMENTS

| | | |
|---|---|---|
| 1-20587 | 1/1989 | Japan . |
| 1-118878 | 5/1989 | Japan . |

*Primary Examiner*—A. T. Grimley
*Assistant Examiner*—P. J. Stanzione
*Attorney, Agent, or Firm*—Foley & Lardner

[57] ABSTRACT

An image forming apparatus for forming a toner image on a recording medium. The apparatus includes a photosensitive drum on which a latent image is formed, a developing/cleaning device for developing the latent image with a developing agent and for removing the developing agent remaining on the photosensitive drum therefrom while the latent image is developed, and a transfer device for transferring the developed image on the photosensitive drum to the sheet. The apparatus further includes a disordering device for disordering the developing agent remaining on the photosensitive drum, after transfer of the developed image by the transferring means, to render the developed image non-patterned. The disordering device includes a contact member having projections and depressions formed with a prescribed inclined angle relative to the direction intersecting at right angles the rotating direction of the photosensitive drum at the contact portion with the photosensitive drum.

13 Claims, 8 Drawing Sheets

IMAGE FORMING APPARATUS

BACKGROUND OF THE INVENTION

1. Field of the Invention

The present invention relates generally to an image forming apparatus, and more particularly, to an image forming apparatus for developing an electrostatic latent image formed on a photosensitive drum, and for transferring the developed image onto an image recording medium such as paper.

2. Description of the Related Art

Conventional image forming apparatus include electrophotographic devices, electrostatic printers, etc. In the case of conventional image forming apparatuses, an electrostatic latent image is formed on a photosensitive drum. Toners are then electrostatically adhered to the latent image as developing agents, so that a toner image corresponding to the latent image is developed.

Subsequently, the toner image is transferred on an appropriate image recording medium, such as a copy sheet. After the completion of the image transferring, the electrostatic latent image and residual toner particles remain on the photosensitive drum. The residual toner particles are removed from the drum by a cleaning device. The electrostatic latent image is then removed from the photosensitive drum by a discharging device.

Recently, it has been demanded to reduce the size of the image forming apparatus. In this connection, Japanese Patent Disclosure No. Sho 47-11538 discloses an image forming apparatus having a reduced size by using a photosensitive drum having a reduced diameter and a device which serves as an image developing device and a cleaning device.

In the prior art, a photosensitive drum rotates twice in an image forming cycle. An image developing process is carried out by the device in the first rotation of the photosensitive drum, while a cleaning process is carried out by the device in the second rotation of the photosensitive drum.

The prior art devices, however, have some problems. That is, the image forming speed is halved, in comparison to conventional devices, because the photosensitive drum must rotate twice in the one image forming cycle. Further, the size of image recording media, i.e., copy sheets, is limited to a relatively small sheet size, because the length of the copy sheets available for the apparatus is required to be less than the peripheral length of the photosensitive drum and the photosensitive drum, as explained above, has a reduced diameter.

U.S. Pat. No. 4,727,395 discloses an image forming apparatus having a device which carries out concurrently the image developing process and the cleaning process. The image forming cycle of the apparatus is performed within one rotation of its photosensitive drum. Thus, the latter prior art has reduced the size of the apparatus without lowering the image forming speed.

The latter prior art, however, has another problem. That is, in the latter prior art, the residual latent image and the residual toner image still remain in the next image forming cycle. The charging process, the latent image forming process and the developing process in the next cycle are carried out on the residual latent image and the residual toner image. Thus, a resulting image formed in the next cycle is deteriorated by the residual images remaining from the preceding cycle.

This kind of image deterioration becomes noticeable when a so-called solid area of the resultant image (i.e., a resultant toner image having a wide area) overlaps a residual latent image. Moreover, the residual toner image also appears on the resultant image and deteriorates the image.

Thus, the prior art image forming apparatus fail to produce satisfactory distinct images. Also, the making of the photosensitive drum smaller than the size of the image recording media has not been achieved.

SUMMARY OF THE INVENTION

It is, therefore, an object of the present invention to provide an image forming apparatus which is reduced in size, without damaging a resultant image.

In order to achieve the above object, an image forming apparatus according to one aspect of the present invention includes means for forming a latent image on a movable image bearing member; developing and cleaning means for developing the latent image with a developing agent, and for removing the developing agent remaining on the image bearing member therefrom while the latent image is developed; means for transferring the developed image on the image bearing member to a recording medium; and means for disordering the developing agent remaining on the image bearing member after transfer of the developed image by the transferring means to render the developed image nonpatterned, the disordering means including a contact member having projections and depressions formed with a prescribed inclined angle relative to the direction intersected at right angles to the moving direction of the image bearing member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The present invention will be described in detail with reference to FIGS. 1 to 10.

Figure 1:
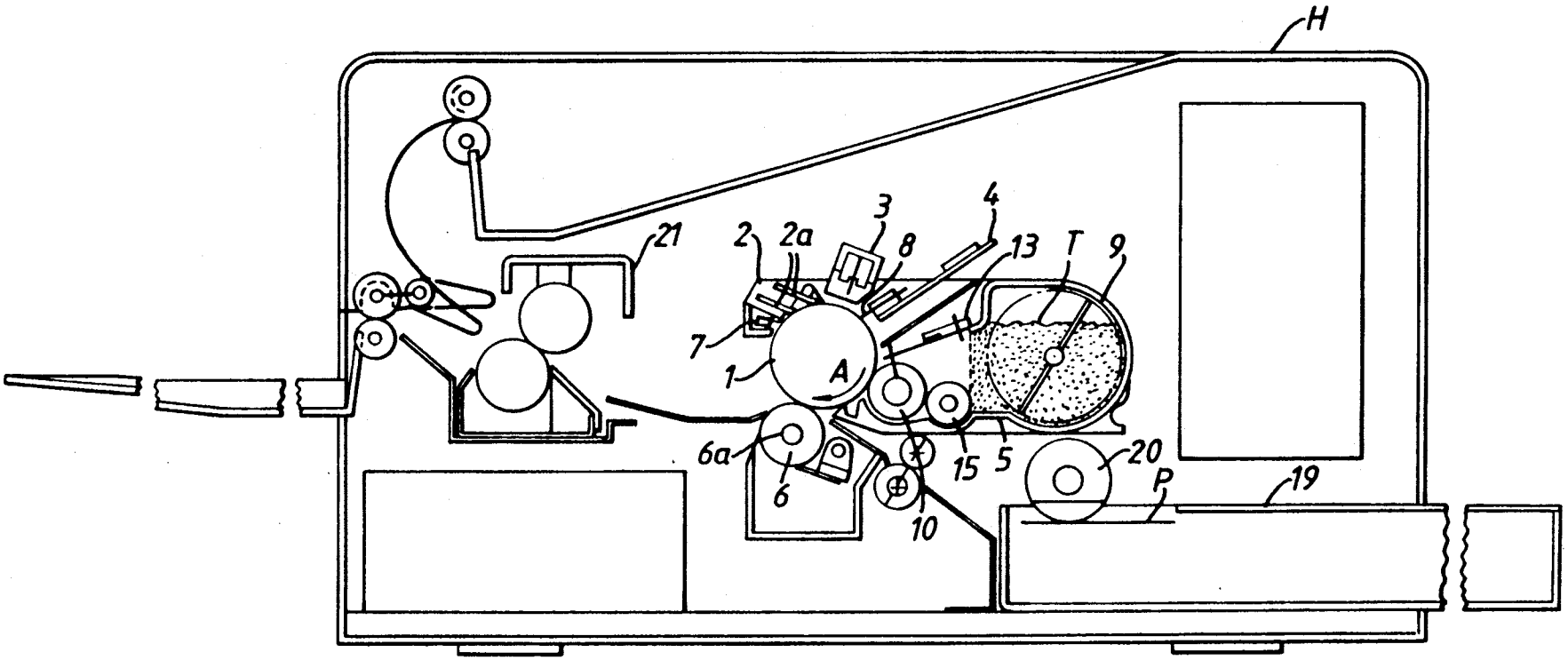
FIG. 1 is a section view of an image forming apparatus according to an embodiment of the present invention.

Referring now to FIG. 1, a preferred embodiment of the image forming apparatus according to the present invention will be described in detail. Photosensitive drum 1 is disposed substantially in the center of housing H as an image bearing member. The photosensitive drum 1 has a smaller recording surface than the area of the sheet on which the developed image is transferred (that is, a small diameter). The photosensitive drum 1 is rotatable in the direction of arrow A. The photosensitive drum 1 is formed of photoconductive material of the organic photosensitive (OPC) group and has a drum diameter of 40 mm. Charge removing device 7, disordering device 2, scorotron charger 3, electrostatic latent image forming device 4, developing/cleaning device 5 and transfer roller 6 are arranged around the periphery of photosensitive drum 1 in the direction of its rotation.

The operation of the image forming apparatus of this embodiment will now be described.

Photosensitive drum 1 is rotated in the direction of arrow A and the peripheral surface of photosensitive drum 1 is charged to −500 to −800 V by scorotron charger 3. Then, the charged area is exposed by the irradiation of light beam 8 in response to image information from electrostatic latent image forming device 4 which is composed of an EL (edge emitter array). As a result, an electrostatic latent image is formed on the surface of photosensitive drum 1.

The electrostatic latent image formed on the surface of photosensitive drum 1 is transported to the developing and cleaning position facing developing/cleaning device 5 by the rotation of photosensitive drum 1. Hopper 9, which stores friction chargeable so-called non-magnetic one-component toner T as a developing agent, is provided in developing/cleaning device 5. Developing roller 10 is arranged in hopper 9 for supplying toner T to photosensitive drum 1, so that the electrostatic latent image on the photosensitive drum 1 is developed to a toner image. Developing roller 10 also operates as a cleaning roller to remove a residual toner from photosensitive drum 1 and to restore residual toner into hopper 9 when the developing operation is achieved.

Developing roller 10 comprises a roller shaft, an elastic layer surrounding the roller shaft and a conductive surface layer surrounding the elastic layer so that developing roller 10 is elastic. The elastic layer is made of, for instance, foamed polyurethane, silicon rubber, urethane rubber or diene rubber. The conductive surface layer is made of conductive material with a resistance of $10^2$ to $10^8$ Ω·cm.

Developing roller 10 rotates in friction with friction blade 13 thus causing a frictional electricity. Friction blade 13 is made of phosphor bronze, polyurethane resin or silicon resin. Thus, toner T on the developing roller 10 is charged when toner T passes through between the surface of developing roller 10 and frictional blade 13 and formed one to three layers of toner T. The charge or a frictional charge charged on toner T has the same polarity as the charge on photosensitive drum 1, i.e., the negative charge which has been previously charged by scorotron charger 3. Here the material of the conductive surface layer of developing roller 10 must be selected taking into account the friction charging of toner T and also considering suitable elastic and frictional properties.

The material for the conductive surface layer may be formed by coating, for instance, a mixture of urethane resin with 10 to 30 weight percent of conductive carbon. Moreover, a bias power source (not shown) is connected to developing roller 10, and is electrically connected with the conductive surface layer. By this means, a specified developing bias is applied to the conductive surface layer during developing and cleaning. Sponge-like toner feeding roller 15 is arranged inside hopper 9. Toner feeding roller 15 serves to feed the toner T to developing roller 10 and to rake the toner T for preventing a cohesion of the toner T in hopper 9.

Toner T is fed from developing roller 10 of developing/cleaning device 5. Developing roller 10 makes contact with a nip width with photosensitive drum 1, on which the latent image has been formed, by elastic deformation, and a toner image is formed by causing the adherence of toner T. In this case, toner T adheres to the area which has been irradiated by light beam as so-called 'reverse development'. Toner T is charged to approximately −5 to −30 μc/g by the friction of blade 13 and the conductive surface layer of developing roller 10, and a voltage of approximately −150 to −450 V is applied to developing roller 10.

After developing, the toner image is transported to the transferring area which faces transfer roller 6 by further rotation of photosensitive drum 1.

At the same time, sheet P from sheet feeding unit 19 is fed in synchronisation with the rotation of photosensitive drum 1 by the rotation of sheet feed roller 20. The reverse side of sheet P is applied with a bias voltage biased towards plus by transfer roller 6, and the toner image on the surface of photosensitive drum 1 is electrostatically attracted to sheet P by this bias voltage, and is transferred onto sheet P.

An AC bias voltage biased towards plus is applied to rotating shaft 6a of transfer roller 6. This voltage is applied to the surface of transfer roller 6, which has a surface conductivity of $10^5$ to $10^9$ ω·cm, via conductive portions, made of a mixture of silicon resin with 5 to 40 weight-percent of conductive carbon, provided at both ends of transfer roller 6. In order to make foreign matter, such as adhering developing agent and paper dust, easily cleanable from the surface of transfer roller 6, it is desirable to use a material which has smoothness and a low friction property. In this embodiment, good cleaning is performed by a cleaning blade using such materials as conductive polyfluoride resin and conductive polyester. Also, for the rubber hardness of the roller as a whole, good results were obtained using a soft material, with a relative measurement of 25° to 50° by the JIS (Japanese Industrial Standards) method. The rubber hardness of the roller gave a great tolerance to the pressure of transfer roller 6 against photosensitive drum 1.

After transferring, sheet P is conveyed to fixing device 21, and is dispensed from the apparatus after the toner image has been melt-fixed on sheet P.

The residual toner and the electrostatic latent image remaining on photosensitive drum 1 after transferring are mostly removed by passing through charge removing device 7. Then, conductive brush 2a of disordering device 2 rubs photosensitive drum 1 during the rotation thereof, so that the residual toner is thoroughly disordered and made non-patterned.

After the electrostatic latent image is eliminated and any residual toner has been made non-patterned, photosensitive drum 1 is charged at the specified potential by scorotron charger 3. At this time, the residual toner on photosensitive drum 1, which has been made non-patterned and scattered in a fog-like state, is also given a negative charge and is cleaned off in developing/cleaning device 5, and the above processes are repeated.

Here, although charge removing device 7 uses a red LED, in order to discharge the charge of the photosensitive body after transferring of the toner, a stronger light is required than in a conventional cleaning device. That is, approximately 8 to 20 times the quantity of light when using a discharge lamp as the light source is required.

Also, disordering device 2 has conductive brush 2a, which is made of fiber having an electrical resistance of $10^3$ to $10^9$ $\omega$·cm, as the toner disordering member. Brush 2a is positioned to rub against photosensitive drum 1 and, at the same time, brush 2a receive an AC bias voltage biased towards plus.

The above process which does not use a conventional cleaning device will now be described in more detail.

A small amount of toner which has not been transferred onto sheet P and the electrostatic latent image remain on the surface of photosensitive drum 1 after transferring of the bulk of the toner. The residual electrostatic latent image is eliminated by a red LED as charge removing device 7. However, since the after-transferring residual toner shields the light, a greater quantity of discharge light is required than in a conventional apparatus having a cleaning device. A quantity of light which is 8 or more times that using a discharge lamp as the light source is required.

Furthermore, any toner image remaining after transferring is transported to disordering device 2 and is made non-patterned. As described above, in disordering device 2, the after-transferring residual toner is disturbed to an unreadable state by the contact of brush 2a with the residual toner and the electrostatic latent image, which exerts electrostatic and mechanical force.

Thus, the after-transferring residual toner image on the surface of photosensitive drum 1, which has passed through disordering device 2, is thoroughly distributed in a fine fog-like state and no longer has any information such as characters or an image. In this way, the after-transferring residual toner image returns to the charging process after having become thoroughly non-patterned.

Photosensitive drum 1, which has been charged by scorotron charger 3, is exposed, and an electrostatic latent image is formed on drum 1 by electrostatic latent image forming device 4 after charging. Photosensitive drum 1 then reaches the developing/cleaning position facing developing/cleaning device 5 once more (the second time). In this case, either the exposed portion (the image portion to which the toner should adhere) or the unexposed portion (the non-image portion) of the electrostatic latent image formed during the second time is greatly reduced by the previous roller transferring, and furthermore, since the residual toner is almost uniform and is thoroughly and thinly dispersed, no exposure randomness will occur. Therefore, even in the second developing, since the residual potential becomes uniform after exposure, a uniform toner image can be obtained.

Here, in order to give developing roller 10 an elasticity of 30° to 70° by the JIS rubber hardness measurement method and, at the same time, a conductivity of $10^2$ to $10^8$, a load of 20 to 150 g/cm is applied to developing roller 10 as a linear load, and developing roller 10 is caused to make pressure contact with a speed difference of 1.5 to 4 times. By this means, a contact width (nip) of 1 to 4 mm is produced. Since the after-transferring residual toner and toner T on developing roller 10 are agitated and rubbed in this nip, a strong frictional force is generated and this increases the cleaning power. Furthermore, since the developing agent is formed by toner T alone, reduction of picture quality such as fine lines or brush marks will not occur.

In the unexposed portion, since the attraction due to the developing bias voltage exceeds that of photosensitive drum 1, the adhering toner T is successively collected by being attracted to developing/cleaning device 5. That is, by applying a developing bias voltage with an appropriate value between the residual potential of the exposed portion and the potential of the unexposed portion on developing roller 10, the fresh toner from developing roller 10 adheres to the exposed portion. At the same time, the after-transferring residual toner adhering to the non-image area (non-image portion) is attracted to developing roller 10 and is collected. In this case, since there is a small quantity of after-transferring residual toner and this residual toner is distributed beforehand in a fine fog by disordering device 2, developing/cleaning device 5 is able to efficiently collect the after-transferring residual toner, and poor collection does not occur.

In this way, one sheet of recorded image is obtained using repetition by the repeated rotation of photosensitive drum 1.

Then, after developing and cleaning, the toner image is transferred onto sheet P at a position facing transfer roller 6. Thereafter, the same processes are repeated.

Figure 2A:
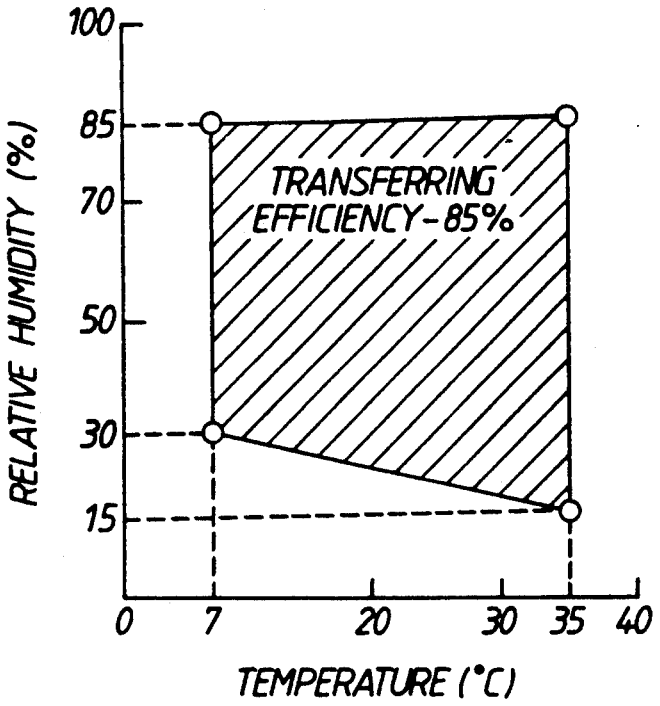
FIG. 2A is a graph showing characteristics of the transferring a toner image onto an image recording medium by using a roller.

The good transferring characteristic region (operational environment) for transfer roller 6 is shown by the hatched lines in FIG. 2A. The bias condition is AC 1600 V/2 kHz on which DC +600 V is superimposed.

Figure 2B:
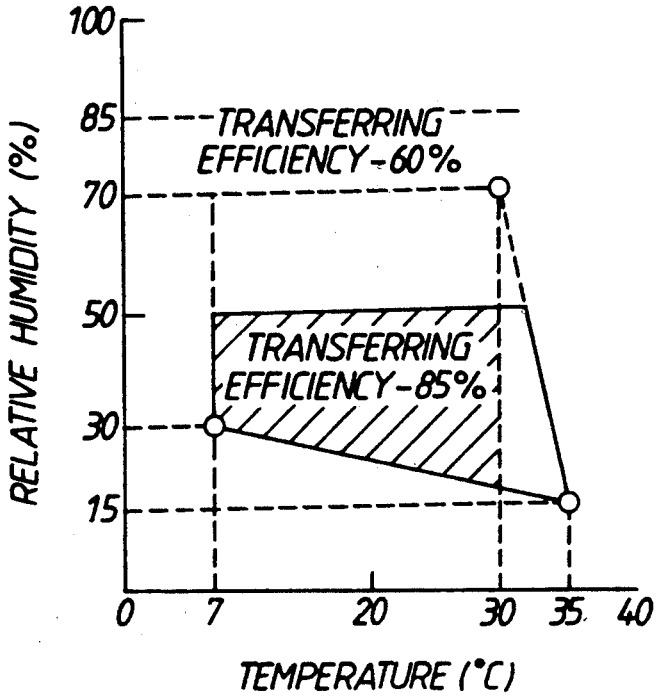
FIG. 2B is a graph showing characteristics of the transferring a toner image onto an image recording medium by using a corona charger.

Also, the measurements for a transferring method using a corona charger of the prior art are shown in FIG. 2B.

From a comparison of these, a transferring efficiency of 85% or more was obtained by transfer roller 6 in the relative humidity region of 30 to 85%. As opposed to this, a transferring efficiency of above 85% under a humid environment could only be obtained by the transferring method using a corona charger in the 30 to 50% humidity region. Also, the transferring efficiency will be less than 60% in a humid environment of 70% or more.

Therefore, when a transferring method using a corona charger which does not posses a cleaning device, that is to say a cleanerless recording apparatus, is used, the after-transferring residual toner increases under humid conditions, and a greater load is placed on disordering device 2 and developing/cleaning device 5. The increase of after-transferring residual toner means an increase of the toner deposited in disordering device 2. This results in the occurrence of soiling inside the apparatus and reduction of after-transferring residual toner non-patterning efficiency. When the after-transferring residual toner non-patterning efficiency of disordering device 2 is reduced, a residual memory image will occur in every process. Fogging will also occur, since a thorough cleaning cannot be performed by developing/-cleaning device 5. Thus, it is desirable to adopt the contact transferring method in a cleanerless recording apparatus.

From the above facts, by contact transferring using transfer roller 6 having elasticity and conductivity, the after-transferring residual toner can be reduced extremely efficiently over a wide range of the operational environment. At the same time, since the roller directly contacts sheet P when transferring, the adsorption and elimination of the sheet dust which adheres to sheet P can be efficiently performed. Thus the residual matter adhering to photosensitive drum 1 after-transferring is greatly reduced. Also, since reversal of the charge on the after-transferring residual toner does not occur, the occurrence of memory images can be prevented.

Moreover, since sheet P is mechanically pressed by using transfer roller 6, transferring omissions (partial missing transferring) are prevented and, at the same time, there is less influence from the size and quality of sheet P. Thus sharp images will be transferred onto sheet P.

Also, if this embodiment is used, even though photosensitive drum 1 with a small diameter is used, not only is there absolutely no occurrence of the memory images which occur in prior art, but also poor cleaning can be prevented.

The effect of the superimposition of AC and DC in the bias applied to disordering device 2 and transfer roller 6 will now be described.

Figure 3:
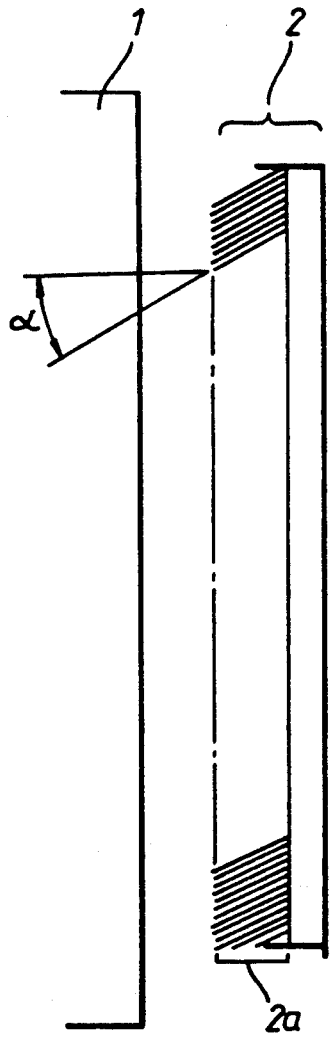
FIG. 3 is a schematic view showing the composition of a disordering device.

As shown in FIG. 3, brush 2*a* of disordering device 2 differs from a roller. Projections and depressions are formed in the surface of brush 2*a*, with directionality (inclined angle $\alpha$) relative to the direction intersected at right angles to the rotating direction of photosensitive drum 1, at the contact portion with photosensitive drum 1.

Also, since an AC bias is applied to disordering device 2, the after-transferring residual toner repeats forward and reverse transfer between brush 2*a* and photosensitive drum 1.

Therefore, while repeating forward and reverse transfer in accompaniment with the rotation of photosensitive drum 1, the position of the residual toner remaining on photosensitive drum 1 gradually changes. Thus, the patterns of any characters and lines remaining at the time of transferring are disturbed, and the pattern information is eliminated after passing through disordering device 2.

If the inclined angle $\alpha$ becomes too large, not only does the driving torque of photosensitive drum 1 increase, but also a transverse line image is liable to form on photosensitive drum 1 when the toner is reverse-transferred from disordering device 2. Therefore, a good effect can be obtained when the inclined angle $\alpha$ is within the limits 5° to 60° or −60° to −5°, and preferably 10° to 45° or −10° to −45°.

Also, it was found that, if the width and depth of the projections and depressions at the contact portion of disordering device 2 with photosensitive drum 1 are not greater than the mean particle diameter of the toner, the position of adherence to photosensitive drum 1 when the toner is reverse-transferred from disordering device 2 does not easily slip.

Figure 4:
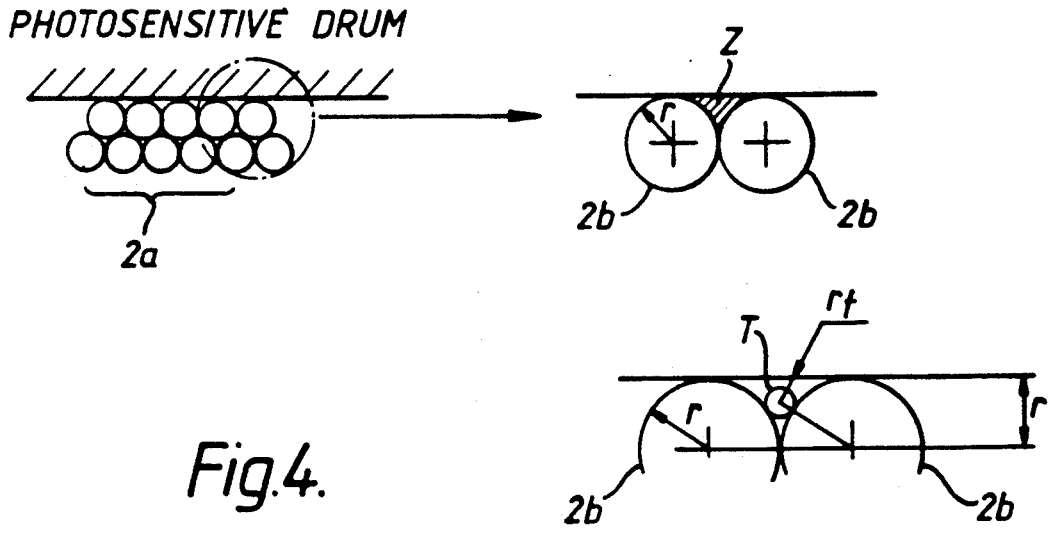
FIG. 4 is an enlarged schematic view of the contact portion between the disordering device and a photosensitive drum.

That is, in brush 2*a*, which is disordering device 2 of this embodiment, as shown in FIG. 4, taking space Z formed between fibers 2*b* and 2*b* of brush 2*a* and photosensitive drum 1 as being larger than the mean particle diameter of toner T as the condition, when taking the mean particle radius of toner T as rt (μm) and the radius of fiber 2*b* of brush 2*a* as r (μm), $$r > (r+rt)^2 - r^2 + rt$$

is obtained, and when this inequality is rearranged, $$r > 4rt$$

is obtained.

Therefore, the radius r of fiber 2*b* of brush 2*a* may be 4 or more times the mean particle radius rt of toner T. This agrees with results from experiments.

Figure 5:
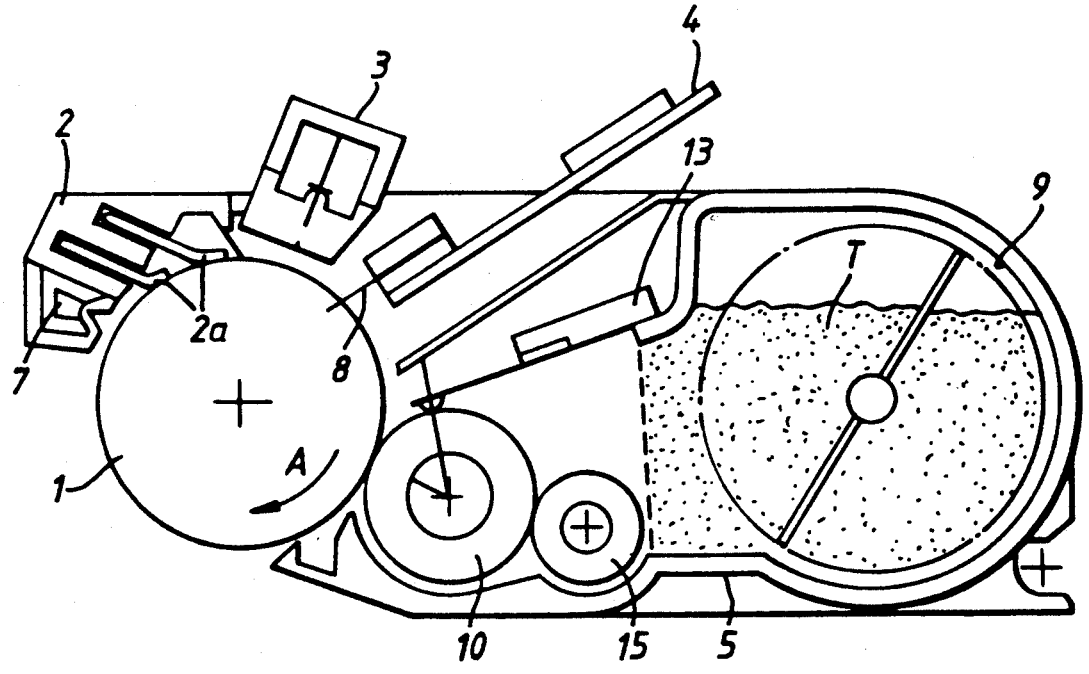
FIG. 5 is a schematic view showing the composition of another embodiment of the disordering device.

The effect of disordering device 2 is not limited to when an AC bias is used, DC alone may also be used. Also, as shown in FIG. 5, multiple brushes 2*a* may be provided.

Figure 6:
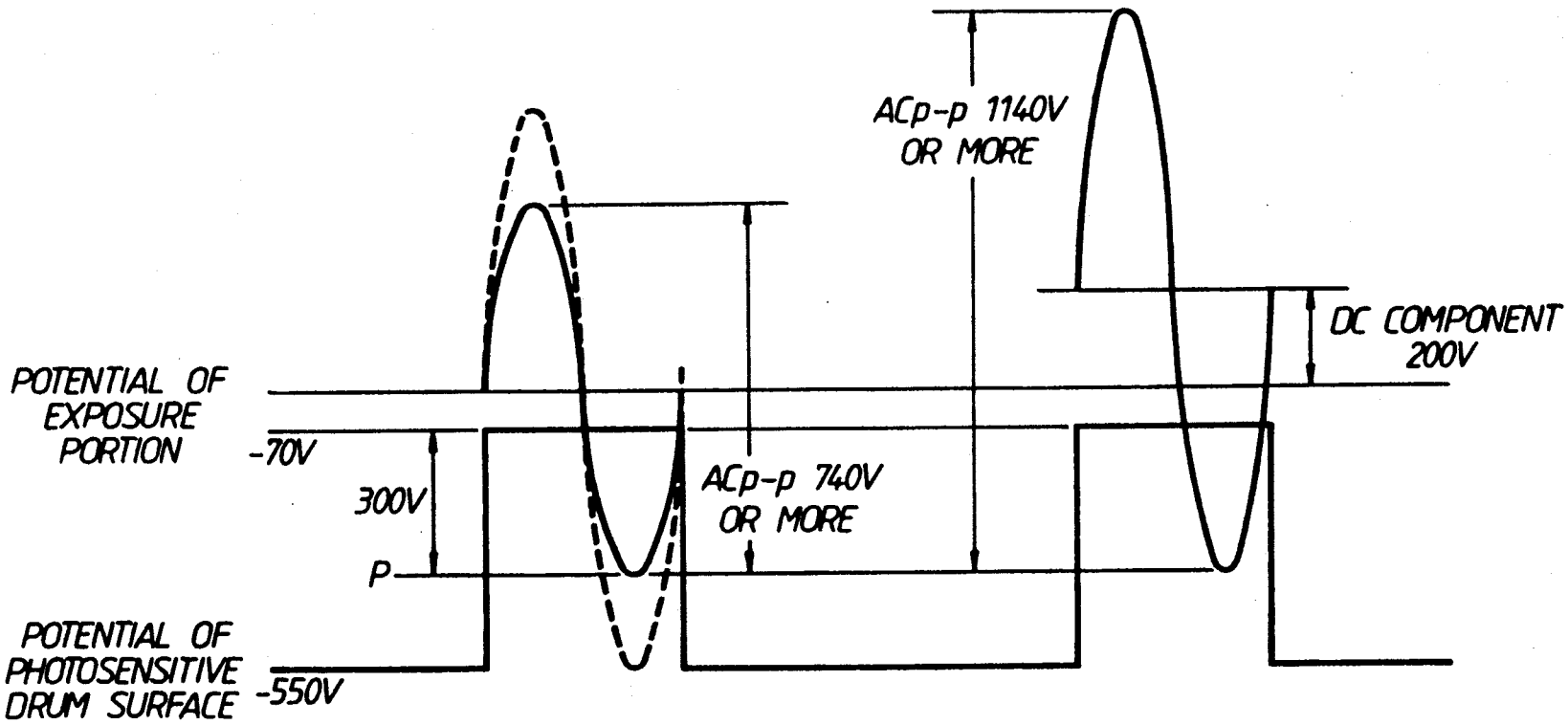
FIG. 6 is a graph showing the bias voltage which is applied to the disordering device.

As described above, by applying a bias voltage with an AC component and using disordering device 2 in the form described above, non-patterning of the residual toner can be achieved by generating repeated transfer and reverse transfer of the residual toner. Since the transfer/reverse transfer of the toner will not occur when the potential difference between the brush and the photosensitive drum is not in excess of 300 V, as shown in FIG. 6, the bias waveform peak must alternate with the potential of the image area (in other words, the exposed portion potential). For instance, in the case of the surface potential being −550 V, the exposed portion potential being −70 V and the DC component being 0 V, the effect can be obtained with an AC 'peak to peak' of 740 V or more.

However, in order to perform thorough non-patterning of the after-transferring residual toner and to prevent the occurrence of image memory, it is desirable to make the toner adhere to brush 2*a* by superimposing a DC bias voltage which is the reverse polarity to that of the toner. At the same time, it is desirable to cause reverse transfer of part of the toner to photosensitive drum 1 from brush 2*a* while non-patterning the residual toner. Therefore, it is effective to apply a bias in which positive DC is superimposed on AC. For instance, a good effect can be obtained with AC with a 'peak to peak' of 1140 V when the DC component is +200 V.

However, in the case of applying a DC bias voltage biased towards plus, toner is liable to accumulate on brush 2*a* since this is the direction for toner attraction. For this reason, it is desirable to cause a toner discharge or removing operation from brush 2*a* during initializing operation of the apparatus, between an image forming operation for a sheet and the next image forming operation for a next sheet and on completion of image forming operations. For this discharge operation, methods such as applying a minus DC bias voltage or applying AC voltage biased towards minus during initializing operation of the apparatus, between an image forming operation for a sheet and the next image forming operation for a next sheet and on completion of image forming operation can be considered.

Figure 7:
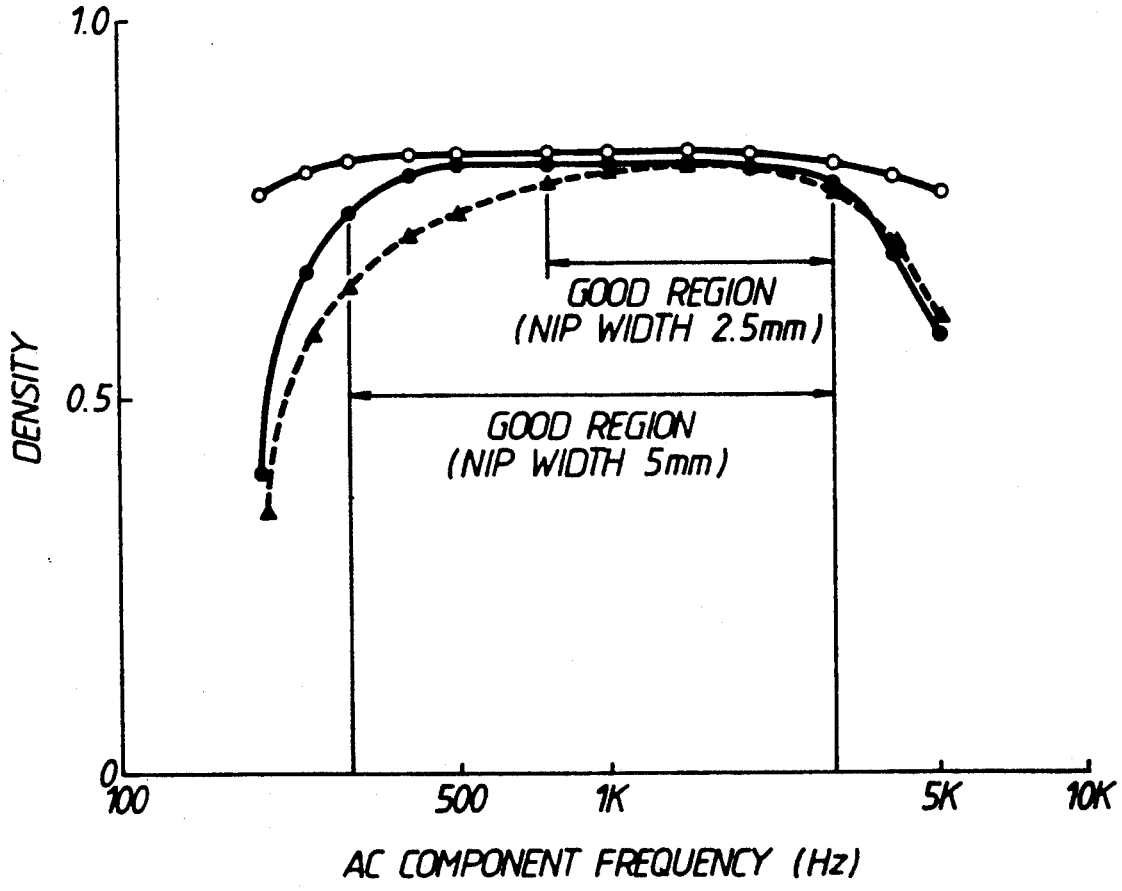
FIG. 7 is a graph showing the frequency effect of the memory elimination effect due to the disordering device.

Also, in order to perform thorough non-patterning of the residual toner image, it is necessary to perform the reciprocal operation of transfer/reverse transfer a number of times. For instance, when using a brush of the composition shown in FIG. 3, the results of studying the occurrence of image memory when applying DC voltage of +400 V and peak-to-peak AC voltage of 1400 V and changing the frequency from 200 Hz to 5 kHz are shown in FIG. 7. The composition (not shown) of the brush at this time was formed by sewing fibers of a diameter of 20 to 200 μm and resistance value $10^5$ ω·cm on cloth and sandwiching this with aluminium plate. The projecting length of the brush from the aluminum plate was approximately 8 mm, and the longer the contact portion upstream of the direction of rotation of the photosensitive drum, the longer this length will become.

The memory image operation in the process not using a conventional cleaning device will now be described.

When the after-transferring residual toner image is charged by the corona in the charging process without thorough non-patterning, part of the toner image will also be charged at −550 V. At this time, the residual toner is strongly negatively charged by the charging corona. When this part of the residual toner image becomes the non-image portion in the next process cycle, that is to say when exposure is not performed, the residual toner must be eliminated from photosensitive drum 1 by developer/cleaner 5.

However, thorough cleaning will not be carried out when there is a lot of residual toner and, furthermore, non-patterning has not been performed thoroughly. Therefore, the residual toner will be transferred onto sheet P by transferring device 6, and a black memory pattern will appear on the white background. This is called a positive memory.

Also, in the next process cycle, when the residual toner portion is a solid image or half-tone image, in other words the exposure portion, the residual toner shields the exposure. Therefore, either the surface potential of photosensitive drum 1 is not attenuated, or the attenuation will be small in the portion where there is no residual toner.

When developing is carried out in this state, since the developing electric field in the portion where there is some residual toner is weakened, the inside area of the solid image portion or half-tone image portion is eliminated, or the density is reduced, by the pattern of the residual toner. This is called a negative memory.

Generally, a negative memory is more liable to occur, in particular, for half-tone images.

FIG. 7 shows the measurement of the negative memory by dotted lines in a half-tone image with an area coefficient of 50% by changing the AC frequency. The circles with white in the center show the half-tone density of the non-memory portion and the black circles show the negative memory portion (both measured by a microdensitometer). If the difference between the two is a density difference of within 0.05, the density is judged as good by visual assessment. As shown by the solid lines in FIG. 7, in this embodiment good images without memory can be achieved at frequencies of from about 300 Hz to 4 kHz.

In this embodiment, by making the process speed 72 mm/sec and the nip width between brush 2a and photosensitive drum 1 about 5 mm, transfer/reverse transfer of residual toner was repeated about 20 times at a frequency of 300 Hz. That is, it is understood that non-patterning of the residual toner image is achieved by carrying out transfer/reverse transfer 20 times or more.

Also, when the same test was carried out making the nip width between brush 2a and photosensitive drum 1 about 2 mm, good images without memory could be obtained at frequencies of from about 700 Hz to 4 kHz. At this time, non-patterning of the residual image was achieved by performing transfer/reverse transfer about 23 times.

On the other hand, when the frequency is too high, the toner is unable to follow the changes in the electric field, and transfer/reverse transfer cannot be performed. Thus the efficiency of non-patterning of the residual toner reduces at frequencies in excess of about 4 kHz.

The effect of applying an AC bias voltage to transfer roller 6 will now be described.

By applying an AC bias voltage to transfer roller 6, the toner in the transferring region undergoes an oscillating electric field and vibrates. By this means, the transferring sensitivity becomes higher and the transferring efficiency increases. Another effect of applying an AC bias voltage as the transferring bias is to decrease transferring omissions.

If the contact pressure is too great in the contact transferring method, the transferring or omissions of lines or characters are liable to occur due to excessive pressure in the parts to which the toner is adhering. As countermeasures to prevent these omissions, various methods of dispersing the pressure by raising the toner fluidity, by causing a difference in speed between transfer roller 6 and photosensitive drum 1, or by microscopically disturbing the toner image, have been considered. When the toner image is vibrated by applying an AC bias voltage as the transferring bias voltage, an effect equivalent to that of microscopically disturbing the toner image is obtained.

The result of studying the transferring efficiency (temperature of 30° C., humidity of 80%) and character omissions by changing the frequency from 200 Hz to 5 kHz under transferring bias conditions of DC +600 V and AC 2100 V (peak-to-peak) was that the appropriate frequency region is from 600 Hz to 3.5 kHz. The reason is the same as described in the description of the brush. This is that, when the frequency is low, the times of oscillation are less and the effect is weak, while, when the frequency is too high, the toner is unable to follow the changes in the electric field and transferring omissions are also liable to occur. The transferring nip width between transfer roller 6 and photosensitive drum 1 at this time is about 2.5 mm.

Next, the result of carrying out the same test by reducing the hardness of transfer roller 6 and making the transferring nip width about 4 mm, without changing the transferring pressure, was that the appropriate frequency region was of the order of 400 Hz to 3.5 kHz.

From the above results, it was found that a good image without transferring omissions could be obtained by applying an oscillation of 20 cycles or more in the transferring nip.

A 20,000 sheet print test was carried out with the apparatus shown in FIG. 1 under conditions of brush bias voltage of DC +400 V, AC 1400 Vp-p, frequency 2 kHz; transferring bias voltage of DC +600 V, AC 2100 Vp-p, frequency 2 kHz; surface potential of the photosensitive drum −550 V; exposure potential of the photosensitive drum −70 V; both transferring bias and brush bias OFF between an image forming operation for a sheet and next image forming operation for a next sheet. Good printing was maintained without transferring omissions or memory images.

As described above, good prints without charge randomness or memory images can be performed by applying an AC bias voltage to disordering device 2 and carrying out non-patterning of the residual toner image.

When the frequency is too high, the toner cannot follow the changes in the electric field, and when, on the contrary, the frequency is too low, since sufficient toner transfer/reverse transfer cannot be carried out between photosensitive drum 1 and brush 2a, thorough non-patterning of the residual toner cannot be performed, and thus memory images or image randomness will occur.

Even in a humid environment, the transferring efficiency is good and good transferring without transferring omissions can be performed by contact transferring. Also, the occurrence of transferring omissions in character and line images, which are a problem in the contact transferring method, can be prevented by applying an AC bias voltage to the transfer roller. Even using only a disordering device is useful for minimizing memory images and memory randomness in a process not using a conventional cleaning device. Also, the roller transferring device is useful for increasing the transferring efficiency (in particular, in a humid environment) in an ordinary recording apparatus. Having the characteristics of increasing the transferring efficiency, with transferring omissions not occurring even in a humid environment and omissions in characters and lines not occurring, is particularly useful in the transferring device in a process not using a conventional cleaning device. When a combined disordering device and transferring device is used in a process not using a conventional cleaning device, the effect is significantly greater.

A 30,000 sheet print test using the image forming apparatus shown in FIG. 1 was carried out by applying a superimposition of DC +400 V, AC 1400 Vp-p, frequency 2 kHz as the bias voltage applied to brush 2a and a superimposition of DC +600 V, AC 2100 Vp-p, frequency 2 kHz as the bias voltage applied to transfer roller 6. Good picture quality was maintained without transferring omissions or memory images, using photosensitive drum surface potential −550 V and exposure potential 70 V.

An apparatus has been described which uses brush 2a, having conductivity or resistivity, as an example of a rubbing member as the toner disordering member. However, the part which butts against photosensitive drum 1 may be of a shape which has projections and depressions with directionality in regard to the direction of rotation of photosensitive drum 1, and it may be in sheet form or roller form having conductivity or resistivity. Moreover, with regard to the material, a member may be used which is capable of rubbing against photosensitive drum 1 while applying a bias voltage, made of sponge, rubber, etc., which has either conductivity or resistivity.

Figure 8A:
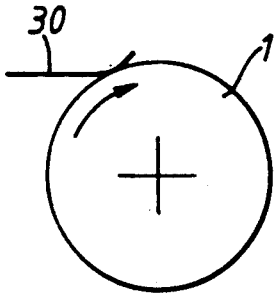
FIG. 8A is a schematic side view showing a sheet form disordering device contacting the photosensitive drum.
Figure 8B:
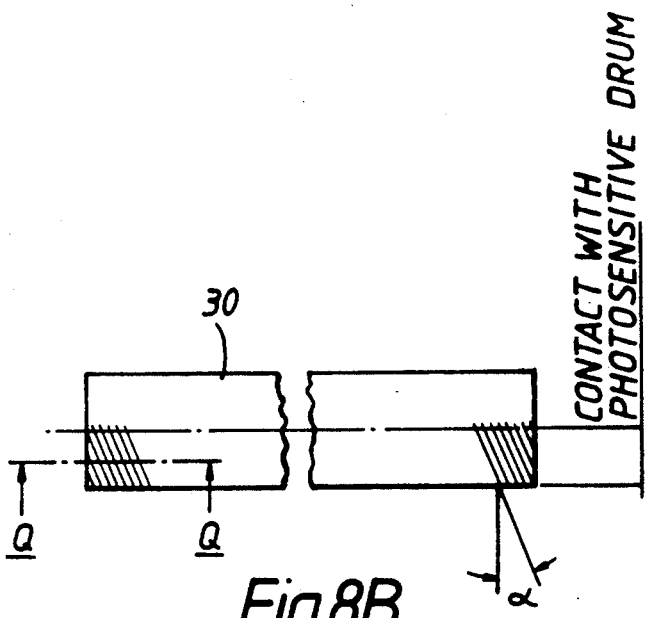
FIG. 8B is a plan view of the sheet form disordering device.
Figure 8C:
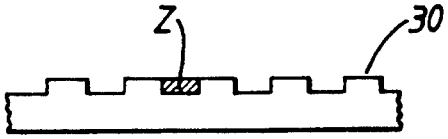
FIG. 8C is an enlarged schematic view taken along the lines Q—Q of FIG. 8B, showing the contact portion of the sheet form disordering device and the photosensitive drum.

For instance, FIG. 8 is an example in which sheet 30 having a conductivity of $10^3$ to $10^9$ $\omega$·cm is used as brush 2a. Vinylidene polyfluoride, teflon, super polyethylene or the like is used as the material. As shown in FIG. 8B, projections and depressions having a directionality of inclined angle $\alpha$ are provided in the part which rubs against photosensitive drum 1. This portion with the projections and depressions is designed as shown in FIG. 8C. Space Z which is formed by contact with photosensitive drum 1 is set at a greater size than the mean particle diameter of the toner used, as described above. Although the form of the projections and depressions shown in FIG. 8C is rectangular, within the purport of the present invention, this form is not limited to rectangular, and it may be a form such as circular, or a sine-curved shape.

Figure 9A:
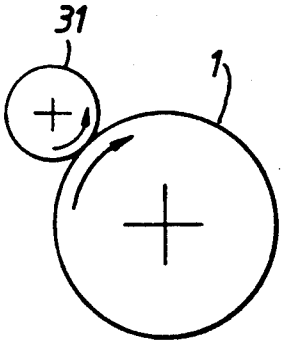
FIG. 9A is a schematic view showing a roller form disordering device contacted with the photosensitive drum.
Figure 9B:
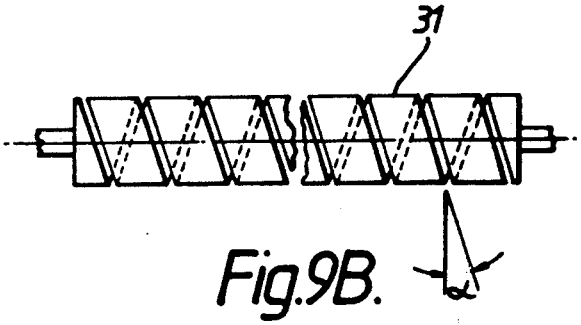
FIG. 9B is a plan view of the roller form disordering device.
Figure 9C:
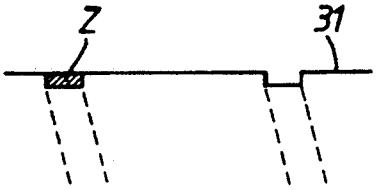
FIG. 9C is an enlarged schematic view of the contact portion of the roller form disordering device and the photosensitive drum.

FIG. 9 is an example in which disordering roller 31 having a conductivity of $10^3$ to $10^9$ $\omega$·cm is used as the toner disordering member. A foam material made of polyurethane, polycarbonate or the like is used as the material. A spiral groove with a lead angle $\alpha$ is formed in the surface of this foam material. The groove is formed as shown in FIG. 9C, and space Z which is formed by contact with photosensitive drum 1 is set at a greater size than the mean particle diameter of the toner used. For instance, a groove of width about 1 to 5 mm, depth about 0.1 to 2.0 mm was formed in the surface of a urethane foam material of resistance value about $10^5$ $\omega$·cm. Moreover, in disordering device 2 which used disordering roller 31, disordering roller 31 rotates in the same direction as photosensitive drum 1 with a peripheral speed of about 1.1 to 3.0 times the peripheral speed of photosensitive drum 1. Good images are obtained with a nip width between photosensitive drum 1 and disordering roller 31 within the limits of about 1.0 to 6.0 mm.

The occurrence of image memories was studied using disordering roller 31 when applying DC +400 V and AC 1400 Vp-p, and changing the frequency from 200 Hz to 5 kHz, and the same results were obtained as in FIG. 7.

Also, in this example, non-patterning of the residual toner image was achieved by applying an AC bias voltage to disordering roller 31 and carrying out transfer/-reverse transfer 20 times or more. On the other hand, when the frequency was too high, the toner could not follow the changes of the electric field, and transfer/-reverse transfer could not be carried out. Therefore, the efficiency of non-patterning of the after-transferring residual toner was reduced at frequencies in excess of about 4 kHz.

Provided there is a peripheral speed difference from photosensitive drum 1, disordering roller 31 may be rotated in the opposite direction to photosensitive drum 1.

Figure 10:
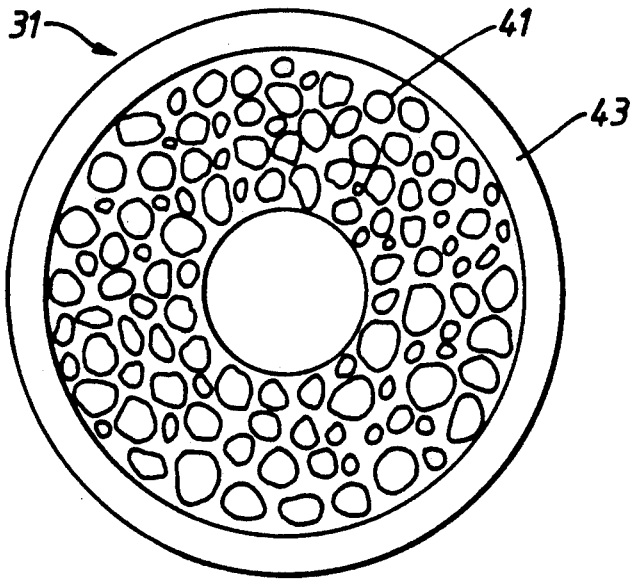
FIG. 10 is a section view showing another embodiment of the roller form disordering device.

Moreover, the same effect was also obtained using a roller in which the surface of foam member 41, made of a material such as polyurethane or polycarbonate, is covered with conductive sheet 43, made of a material such as vinylidene polyfluoride, teflon or super polyethylene, as shown in FIG. 10, for disordering roller 31, and providing a spiral groove (not shown) with lead angle $\alpha$ in the surface of this roller.

In the above embodiment, a non-magnetic one-component developing device is used for making the apparatus most compact. However, the present invention is not limited to this. In the present invention many other developing devices, e.g., a magnetic one-component developing device, a two-component developing device, etc. may be also employed.

Also, the free end of brush 2a, which has conductivity or resistivity, has been positioned downstream in the direction of rotation of photosensitive drum 1 as the disordering member. However, even if it is positioned opposite, this is in no way contrary to the purport of the present invention.

Moreover, any transferring device other than a transfer roller may be used, as long as it has a composition in which an AC bias voltage is applied to a member which has conductivity or resistivity, such as a transferring belt, a transferring bar, or the like.

What is claimed is:

1. An image forming apparatus comprising:

means for forming a latent image on a movable image bearing member;

developing and cleaning means for developing the latent image with a developing agent, and for removing the developing agent remaining on the image bearing member from an earlier image therefrom while the latent image is developed;

means for transferring the developed image on the image bearing member to a recording medium;

means for disordering the developing agent remaining on the image bearing member after transfer of the developed image by the transferring means to render the developed image nonpatterned, the disordering means including a contact member having projections and depressions formed with a prescribed inclined angle relative to the direction intersecting at right angles the moving direction of the image bearing member; and means for applying a bias voltage to the disordering means.

2. The apparatus of claim 1, wherein the contact member of the disordering means comprises a brush having a plurality of fibers.

3. The apparatus of claim 1, wherein the contact member of the disordering means comprises a sheet.

4. The apparatus of claim 1, wherein the contact member of the disordering means comprises a roller having a spiral groove with projections and depressions formed thereon.

5. The apparatus of claim 1, wherein the developing agent comprises toner particles, each having a prescribed diameter, and wherein the width and depth of the projections and depressions at the contact portion of the contact member with the image bearing member are greater than the mean particle diameter of the toner particles.

6. the apparatus of claim 4 further comprising means for rotating the roller at a specified peripheral speed different from the moving speed of the image bearing member.

7. The apparatus of claim 1, wherein the prescribed inclined angle is 10° to 45° or −45° to −10°.

8. An image forming apparatus comprising:

means for forming a latent image on a movable image bearing member;

developing and cleaning means for developing the latent image with a developing agent, and for removing the developing agent remaining on the image bearing member from an earlier image therefrom while the latent image is developed;

means for transferring the developed image on the image bearing member to a recording medium;

means for disordering the developing agent remaining on the image bearing member after transfer of the developed image by the transferring means to render the developed image nonpatterned, the disordering means including a contact member having projections and depressions formed with a prescribed inclined angle relative to the direction intersecting at right angles to the moving direction of the image bearing member; and means for applying a bias voltage to the disordering means, the bias voltage including an AC voltage having a frequency of about 300 Hz to about 4 KHz and a DC voltage superimposed on the AC voltage.

9. An image forming apparatus comprising:

means for forming a latent image on a movable image bearing member;

developing and cleaning means for developing the latent image with a non-magnetic one-component developing agent, and for removing the developing agent remaining on the image bearing member therefrom while the latent image is developed, the developing and cleaning means having an elastic developing roller which contacts the image bearing member, for carrying the non-magnetic one-component developing agent to the image bearing member;

means for transferring the developed image on the image bearing member to a recording medium;

means for disordering the developing agent remaining on the image bearing member after transfer of the developed image by the transferring means to render the developed image nonpatterned, the disordering means including a contact member having projections and depressions formed with a prescribed inclined angle including 10° to 45° or −45° to −10° relative to the direction intersecting at right angles the moving direction of the image bearing member; and means for applying a bias voltage to the disordering means;

wherein the developing agent comprises toner particles each having a prescribed diameter, and wherein the width and depth of the projections and depressions at the contact portion of the contact member with the image bearing member are greater than the mean particle diameter of the toner particles.

10. The apparatus of claim 9, wherein the contact member of the disordering means comprises a brush having a plurality of fibers.

11. The apparatus of claim 9, wherein the contact member of the disordering means comprises a sheet.

12. The apparatus of claim 9, wherein the contact member of the disordering means comprises a roller having a spiral groove to form the projections and depressions thereon.

13. An image forming apparatus comprising:

means for forming a latent image on a movable image bearing member;

developing and cleaning means for developing the latent image with a non-magnetic one-component developing agent, and for removing the developing agent remaining on the image bearing member therefrom while the latent image is developed, the developing and cleaning means having an elastic developing roller which contacts the image bearing member, for carrying the non-magnetic one-component developing agent to the image bearing member;

means for transferring the developed image on the image bearing member to a recording medium;

means for disordering the developing agent remaining on the image bearing member after transfer of the developed image by the transferring means to render the developed image nonpatterned, the disordering means including a contact member having preojections and depressions formed with a prescribed inclined angle including 5° to 60° or −60° to −5° relative to the direction intersecting at right angles the moving direction of the image bearing member; and means for applying a bias voltage to the disordering means, the bias voltage including an AC voltage having a frequency of about 300 Hz to about 4 KHz and a DC voltage superimposed on the AC voltage;

wherein the developing agent comprises toner particles each having a prescribed diameter, and wherein the width and depth of the projections and depressions at the contact portion of the contact member with the image bearing member are greater than the mean particle diameter of the toner particles.

* * * * *